United States Patent [19]

Roming

[11] 4,231,677

[45] Nov. 4, 1980

[54] PROCESS AND APPARATUS FOR FORMING CONCRETE

[75] Inventor: Derek Roming, Carmel, N.Y.

[73] Assignee: International Design Systems, Ltd., Fairfield, Conn.

[21] Appl. No.: 937,125

[22] Filed: Aug. 28, 1978

[51] Int. Cl.[2] ..... E01C 23/02

[52] U.S. Cl. ..... 404/89

[58] Field of Search ..... 404/89, 93, 124, 133, 404/72, 74; 249/9

[56] References Cited

U.S. PATENT DOCUMENTS

| | | | |
|---|---|---|---|
| 139,272 | 5/1873 | Snyder | 404/74 |
| 397,731 | 2/1889 | Laird | 404/124 |
| 947,548 | 1/1910 | Lind | 404/133 |
| 1,007,536 | 10/1911 | Cooley | 404/133 |
| 1,096,445 | 5/1914 | McKesson | 404/133 |
| 2,291,160 | 7/1942 | Johnson | 404/133 X |
| 3,406,618 | 10/1968 | Bowman | 404/72 |
| 3,887,293 | 6/1975 | Bowman | 404/93 X |

OTHER PUBLICATIONS

Stamped Concrete Impressions Training Manual ©1977-S.C.I.

*Primary Examiner*—Nile C. Byers, Jr.

*Attorney, Agent, or Firm*—Brumbaugh, Graves, Donohue & Raymond

[57] ABSTRACT

A lighweight embossing tool for patterning an impressionable surface material, for example freshly poured concrete, comprising a one-man rectangular weight-supporting platform having essentially flat top, bottom and side portions, a centrally located opening formed on the top surface of the platform adapted to receive a shaft, the bottom surface of said platform having rigidly connected thereto a plurality of blades arranged within the perimeter of the platform bottom in a predetermined pattern. The design of the tool is such that the weight of a man standing on both feet on the platform and straddling the centrally located opening is substantially evenly distributed along the blades.

6 Claims, 4 Drawing Figures

PROCESS AND APPARATUS FOR FORMING CONCRETE

The present invention relates to an improved embossing tool for patterning an impressionable surface material such as freshly poured concrete or other similar plastic surfaces. While the technique of imprinting a design such as a brick or Spanish tile motif on a concrete or similar surface is known, see for example U.S. Pat. No. 3,406,618, the prior art tools principally used to effect a design on a suitable surface are fraught with limitations the sum of which make their use both inordinately laborious and expensive.

In the past, embossing tools for patterning concrete, also known as walking tools, have essentially comprised a platform or grid capable of supporting at least one workman and a plurality of blades formed on the bottom surface of the platform, the arrangement of which defined a particular pattern. On the top surface of the platform, enlarged striking areas were formed above the intersections of the blades as well as above other strategic points along the blades, which when hammered would transmit a driving force to the blade edges.

The prior art tools are generally large in scale, owing perhaps to the misguided notion that a large surface area equates with an economy and efficiency of operation. As will be apparent from the following disclosure, quite the opposite has been found to be true, a finding which underscores the continued validity of the popular adage "less is more". Indeed the pulse of the present invention emanates from that very "less is more" concept.

The size (surface area) of the prior art tools is generally such that the average weight of a workman standing or kneeling on the tool platform (grid) is, in and of itself, insufficient to impart an effective driving force to the blades, hence the need for "striking areas" for pounding the blades into the plastic surface. As a result, it has been found difficult at best and more often impossible to achieve a uniform depth of penetration of the blades, a factor lending to an unprofessional appearance of the overall pattern. Moreover, since it is difficult to obtain a uniform depth of penetration of the blades, the tool is often not level with the surface, thus making proper alignment with a second (mating) tool arduous, time consuming and again often impossible.

A further disadvantage of the prior art tools, and again manifestations of their size, is the flotation problem associated with their use. As the term implies the prior art tools when placed on the plastic concrete surface have a tendency to float, at least in those areas which are not being subjected to the weight of a workman.

Closely associated with the flotation problem and an additional limitation imposed on the use of the known tools, is the fact that it is necessary to use a special concrete mix in which the aggregate does not exceed three-eights inch minus ($\frac{3}{8}$"-). Where the aggregate does exceed the $\frac{3}{8}$ inch minus size, penetration of the pattern blades is all but impossible. Obviously, process specifications which require the use of "special" materials rather than the readily available standard materials, i.e. containing a $\frac{3}{4}$ inch aggregate, add to the overall cost and inconvenience of using the known embossing devices and limit their application.

However, perhaps the most significant disadvantage of the prior art tools is the labor cost (viewed as a function of time) associated with their use. By way of example, using four of the known tools, it takes two men nearly a full work day to pattern between three hundred to five hundred square feet. In striking contrast, however, through the utilization of four of the tools according to the present invention, one man is able to realize an eight fold improvement in the amount of area that can be effectively patterned in an average work day.

The principal object of the present invention is to provide a tool which eliminates the aforesaid disadvantages of the prior art devices. Accordingly, the structural design of the present embossing tool is such that it accomodates only one person, whose weight, when standing on both feet on the platform is sufficient to provide an effective driving force to the pattern blades, hence the elimination of the "striking areas" and the need for a supplemental driving force. Moreover, the structural design and dimensions of the novel tool now enables a workman to symmetrically position his weight on the top surface of said tool, thereby causing his weight (driving force) to be evenly distributed along all of the pattern blade edges. The structural design and dimensions of the present embossing tool combine to eliminate flotation, permit the use of any concrete mix and particularly the standard and more economical mix comprising $\frac{3}{4}$ inch aggregates, and to facilitate a quick and essentially mistake proof operation.

The realization of the foregoing hallmarks of the present invention will be apparent from the following detailed description of the embossing tool of the present invention.

DETAILED DESCRIPTION

According to the present invention, the embossing tool, like those known in the prior art, broadly comprises a rectangular upper frame or platform member, the bottom surface of which is rigidly formed with a plurality of blades arranged in a predetermined pattern. However, unlike the prior art tools, the present device is structurally designed so that the platform can accomodate only one workman who when standing on both feet and in any parallel position on the platform effects a transfer of his weight substantially evenly along the embossing blade edges.

More specifically, the structural design of the novel embossing tool contemplates a platform member having the dimensions of not less than twelve inches square and not greater than eighteen inches square. Preferably, however, the dimensions of the platform member should be either sixteen inches square or fourteen by eighteen inches since these dimensions best accomodate the standard brick and tile patterns. The weight of the platform member should not exceed about fifteen pounds nor be less than about thirteen pounds, with the preferred weight of said member being about 14.25 pounds.

The blade portion of the embossing tool is rigidly connected to the bottom surface of the platform. The perimeter of said blade portion essentially conforms to the overall rectangular dimensions of said platform member so that the total number of square inches of the pattern laid down by impressing the tool into a suitable surface is about equal (depending on the blade pattern) to the total surface area of the platform. Within the foregoing parameters, it is further contemplated that the total number of lineal inches of blade rigidly formed on the bottom of the platform member is between about 30 (inches) to about 150 (inches). The depth of the blades range from about one to one and a half inches, with a preferred depth being one and one eighth inches. Moreover, the embossing blades are of a generally V-shaped construction, the included angle of which is from about 10° to 30°, but preferably is about 22°.

In short, the aforementioned advantages afforded by the present device have been realized essentially in light of the discovery of a critical relationship between the overall dimensions of the embossing tool, the weight of platform member and the total number of lineal inches of blade rigidly formed thereon.

Whether the upper frame or platform member is solid or formed with a plurality of openings (the latter being preferred to provide a view of the impressionable surface below the tool), the center of the platform is formed with an opening designed to receive a shaft member, the upper end of which is fitted with a grip. By locating the shaft member in the center of the platform, a workman can uniformly position his feet on the platform to render foolproof the even distribution of weight along the edges of the blades.

As a further feature, the platform is formed with at least one recess on each of two adjacent sides of the platform and at least one protrusion on each of the two remaining adjacent sides of the platform. The recess and protrusion are designed to selectively communicate or interlock, respectively, with a protrusion and recess of the platform member of a second identically designed embossing tool. It is further contemplated that the recesses and protrusions are of the same thickness as the platform member.

The platform member and recesses and protrusions formed on the sides thereof are cast so as to have an accentuated draft. Preferably the draft of the platform member is from about six to eight degrees (6°–8°), principally to facilitate the alignment of the tool with a second tool through respective mating recesses and protrusions. So designed, the embossing tool permits an essentially mistake-proof embossing operation.

The novel embossing tool is fabricated in accordance with conventional aluminum, sand casting techniques. The cast or sand mold is preferably made in two sections in order to impart a double draft to the embossing tool, i.e. a first draft being imparted to the upper platform member by the mold section therefore and a second (reverse) draft being imparted to the blade portion by the mold section therefor. The two mold sections are joined and the resulting casting is of course in one piece. Any durable cast aluminum alloy is suitable for use in the manufacture of the embossing tool of the present invention.

With the foregoing detailed description of the present invention, reference is made to the accompanying drawings which illustrate a preferred embodiment of the novel embossing tool. It should be understood, however, that the invention is not limited to the precise arrangements and structures shown in the drawings.

DESCRIPTION OF PREFERRED EMBODIMENT

Figure 1:
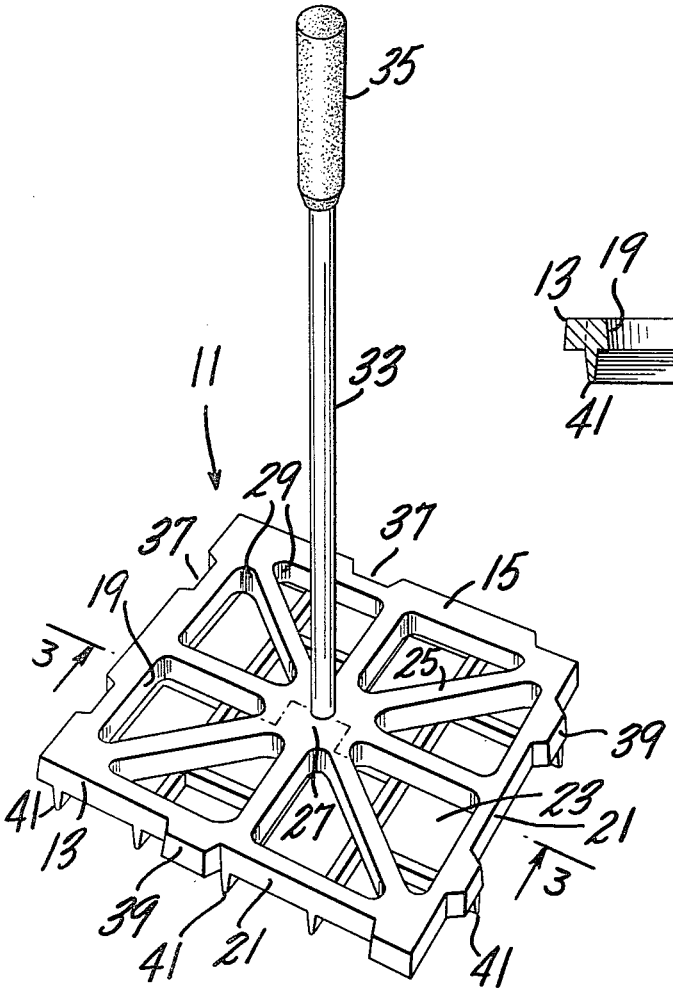
FIG. 1 is a three-quarter top view of the embossing tool.
Figure 3:
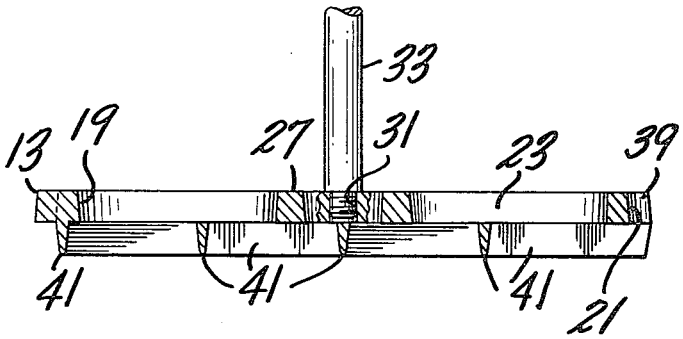
FIG. 3 is a cross-sectional view of the embossing tool taken along line 3—3 of FIG. 1.
Figure 2:
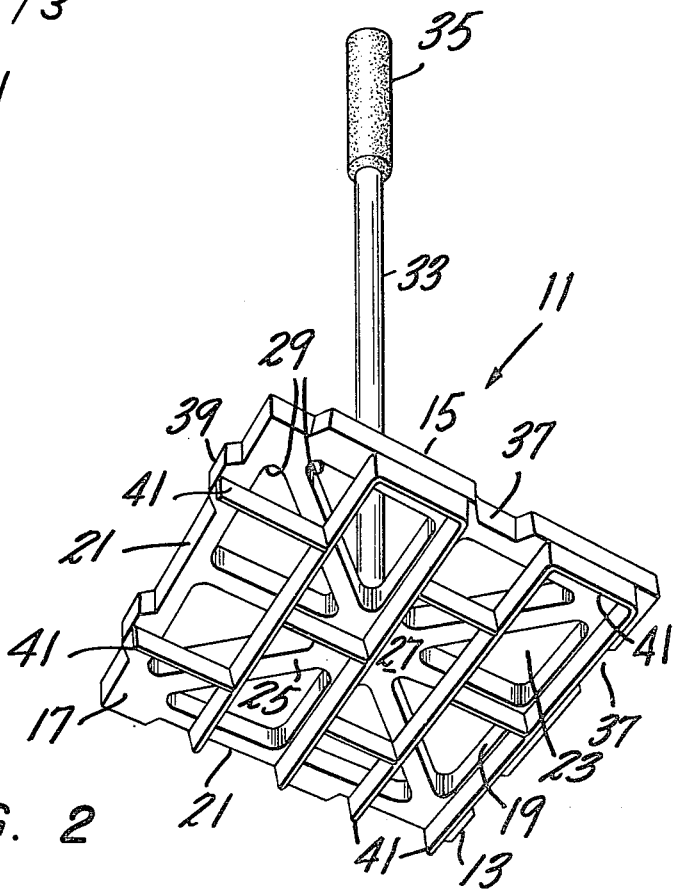
FIG. 2 is a three-quarter bottom view of the embossing tool.
Figure 4:
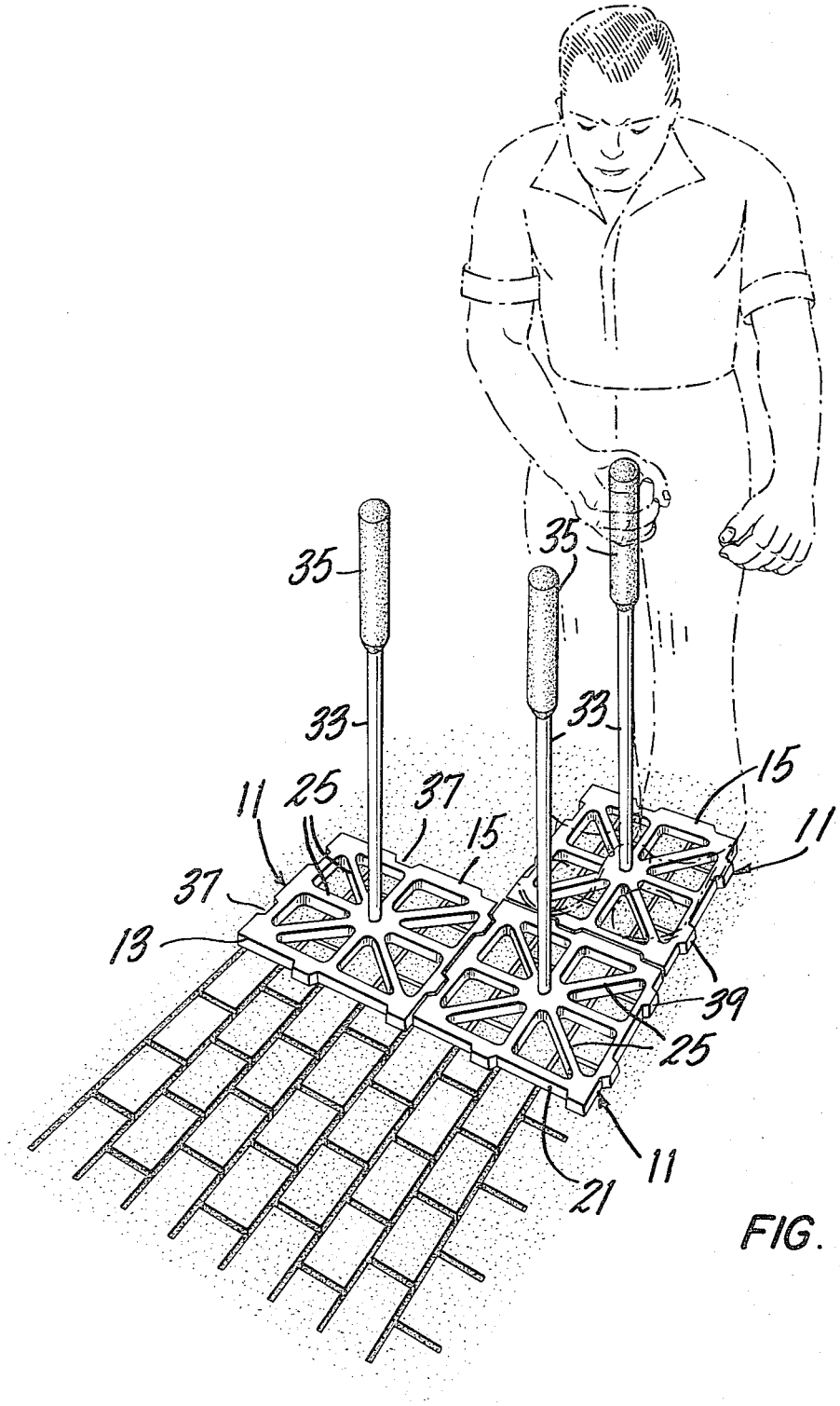
FIG. 4 illustrates the operation of the embossing tools, with workman shown in phantom.
Figure 5:
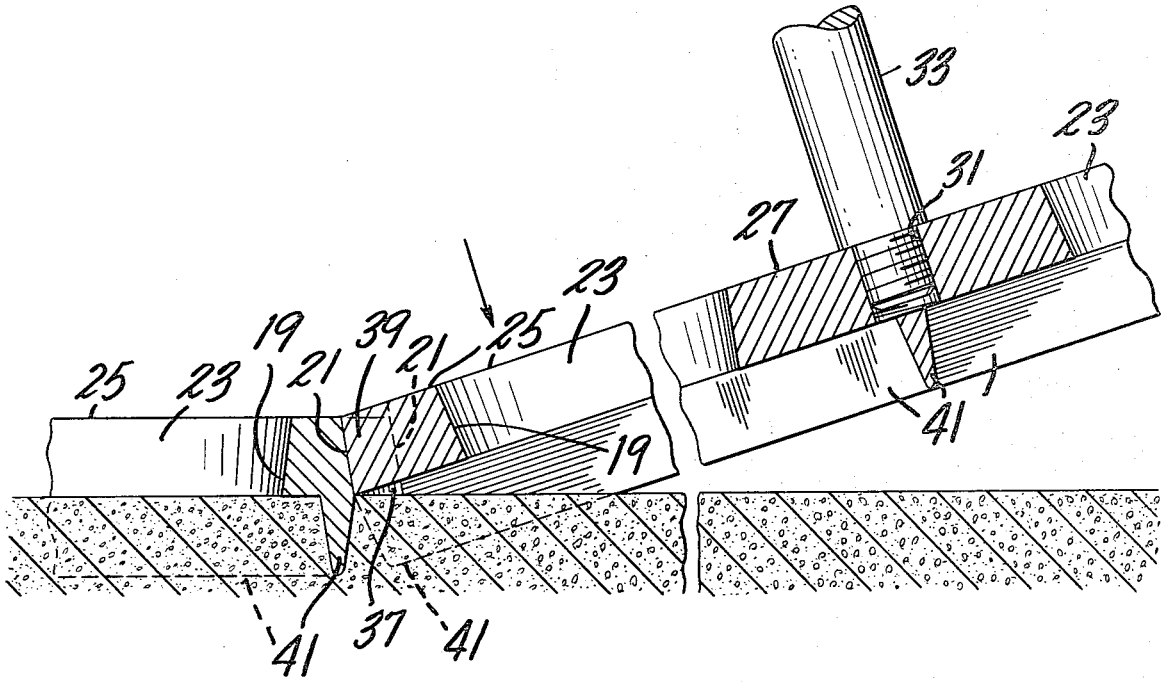
FIG. 5 is an enlarged partial side, partial cross-sectional view of two embossing tools illustrating the technique of alignment by means of mating recesses and protrusions.
Figure 6:
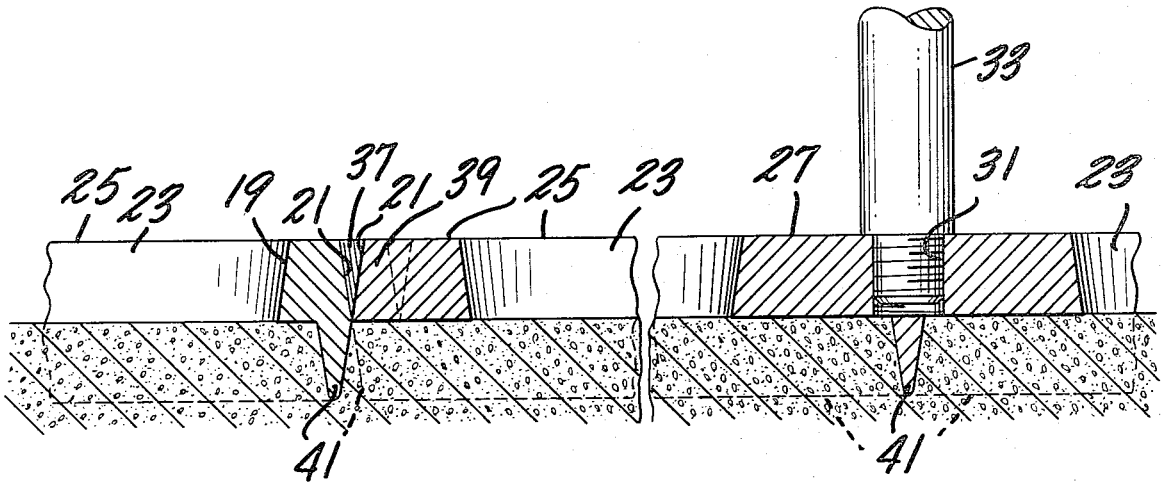
FIG. 6 is an enlarged partial side, partial cross-sectional view of two embossing tools properly aligned.

With reference to the foregoing Figures and particularly FIGS. 1–3, the embossing tool 11 comprises a rectangular weight supporting platform or upper frame member 13, in this instance intended to be a sixteen inch square, having essentially flat top and bottom surfaces 15 and 17, respectively, and essentially flat interior and exterior side portions, respectively 19 and 21. The upper frame 13 is further formed with a plurality of symmetrical openings 23, defined by a plurality of arms 25 which radiate from a center frame portion 27 and which terminate at the interior sides 19 and interior corners 29 of frame 13. An opening 31 is formed in the center of the frame portion 27 and is adapted to receive shaft 33, the terminal end of which is fitted with a grip 35. Two adjacent exterior sides of frame 13 are formed with recesses 37 and the remaining two adjacent sides of frame 13 are formed with protrusions 39. Said recesses and protrusions are of the same thickness of frame 13 and are designed and located so as to mate, respectively, with corresponding protrusions and recesses of a second embossing tool as generally illustrated in FIGS. 4, 5 and 6.

The bottom surface 17 of platform 13 is rigidly connected to a plurality of V-shaped blades 41, which in this instance are intended to have an included angle of about twenty-two degrees. Said blades 41 are arranged in a predetermined pattern shown in the drawings as a conventional brick pattern. The blades 41 extend downwardly from the bottom surface of 17 of frame 13 to a depth of about 1½ inches.

Although the various features of the new and improved embossing tool have been shown and described in detail to fully disclose one embodiment of the invention, it will be evident that changes may be made in such details and certain features may be used without others without departing from the principles of the invention.

What is claimed:

1. A lightweight embossing tool for patterning an impressionable surface material comprising a rectangular weight-supporting platform formed with weight-distributing means and having an essentially flat top, bottom and side portions, a centrally located opening formed on the top surface thereof and adapted to receive a shaft, said platform having dimensions of not less than twelve inches by twelve inches or greater than eighteen inches by eighteen inches; the bottom surface of said platform having rigidly connected thereto a plurality of blades arranged within the perimeter of the bottom of said platform in a predetermined pattern, whereby the bottom of the platform portion limits the depth to which the blades penetrate the impressionable surface, the total number of lineal inches of blade being between thirty and one hundred and fifty.

2. An embossing tool according to claim 1 wherein the side portions of the rectangular platform have an accentuated draft and are formed with at least one recess on each of two adjacent side portions and at least one protrusion on each of the remaining two adjacent side portions, said recesses and protrusions having the same thickness and draft as that of the side portions and designed to selectively mate with a corresponding protrusion and recess of a second identically designed embossing tool.

3. An embossing tool according to claim 1 wherein
(a) the dimensions of the rectangular platform are sixteen inches by sixteen inches or fourteen inches by eighteen inches;
(b) the weight of the platform is not less than fourteen pounds or greater than fifteen pounds; and
(c) the number of lineal inches of the blades are between about 30 to 150 depending on the desired pattern.

4. An embossing tool according to claim 1 wherein the blades are V-shaped and extend below the bottom portion of the platform to a depth of between about one (1) to one and one half ($1\frac{1}{2}$) inches and have an included angle of between about ten degrees (10°) to about thirty degrees (30°).

5. An embossing tool according to claim 4 wherein the depth of the blades is about one and one eighth inches and said blades have an included angle of about twenty-two degrees (22°).

6. An embossing tool according to claim 1 wherein the two adjacent side portions of the platform are formed with two recesses and the remaining two adjacent side portions are formed with two protrusions said recess and protrusions being designed to mate with corresponding protrusions and recesses, respectively, of a second identically designed embossing tool, all of said side portions, recesses and protrusions having an accentuated draft of between six (6°) to eight (8°) degrees.

* * * * *

UNITED STATES PATENT AND TRADEMARK OFFICE

CERTIFICATE OF CORRECTION

PATENT NO. : 4,231,677

DATED : November 4, 1980

INVENTOR(S) : Derek Roming

It is certified that error appears in the above—identified patent and that said Letters Patent is hereby corrected as shown below:

First page, 2nd col., first line of ABSTRACT, "lighweight" should read --lightweight--;

First page, 2nd col., last line, "4 Drawing Figures" should read --6 Drawing Figures--;

Col. 6, line 7, "claim 1" should read --claim 2--.

Signed and Sealed this

*Thirty-first* Day of *March 1981*

[SEAL]

*Attest:*

RENE D. TEGTMEYER

*Attesting Officer*

*Acting Commissioner of Patents and Trademarks*